US007232039B2

(12) United States Patent
Doran

(10) Patent No.: US 7,232,039 B2
(45) Date of Patent: Jun. 19, 2007

(54) CONTAINER STORAGE ORGANIZERS

(76) Inventor: Gerald H. Doran, 133 Ballad Ave., Rochester, NY (US) 14626

( * ) Notice: Subject to any disclaimer, the term of this patent is extended or adjusted under 35 U.S.C. 154(b) by 512 days.

(21) Appl. No.: 10/651,265

(22) Filed: Aug. 28, 2003

(65) Prior Publication Data

US 2005/0045641 A1 Mar. 3, 2005

(51) Int. Cl.
*B65D 21/02* (2006.01)

(52) U.S. Cl. ..... 220/23.88; 211/74

(58) Field of Classification Search ..... 220/3.3, 220/3.6, 4.02, 23.2, 23.4, 23.88, 476, 480, 220/481, 507, 676; 211/71.01, 74, 75, 85.19, 211/85.4; 206/172, 194, 509, 511, 742, 747; 248/311.2, 312

See application file for complete search history.

(56) References Cited

U.S. PATENT DOCUMENTS

| | | | | | |
|---|---|---|---|---|---|
| 1,952,466 | A | | 3/1934 | Sjodin et al. | |
| 2,446,161 | A | * | 7/1948 | Price | 206/172 |
| 2,802,597 | A | * | 8/1957 | Davis | 206/165 |
| 3,307,709 | A | | 3/1967 | Hulterstrum | |
| 3,780,906 | A | * | 12/1973 | Katzenmeyer | 206/170 |
| 4,068,760 | A | | 1/1978 | Johnson, Jr. | |
| 4,378,889 | A | | 4/1983 | Lebowitz | |
| D286,968 | S | | 12/1986 | Gecchelin | |
| 4,836,367 | A | * | 6/1989 | Golkar | 206/200 |
| 4,844,249 | A | | 7/1989 | Coulombe | |
| 4,899,886 | A | | 2/1990 | Johansen | |
| 4,932,533 | A | | 6/1990 | Collier | |
| 5,031,778 | A | | 7/1991 | Edgecombe | |
| D324,883 | S | | 3/1992 | Demirjian | |
| 5,147,038 | A | | 9/1992 | Pergeau | |
| 5,224,596 | A | | 7/1993 | Kruger | |
| D345,071 | S | | 3/1994 | Gould | |
| 5,291,998 | A | | 3/1994 | Fiebig | |
| 5,624,024 | A | * | 4/1997 | Miess | 206/172 |
| D392,482 | S | | 3/1998 | Seenath | |
| 6,152,413 | A | * | 11/2000 | Gretz | 248/343 |
| D437,167 | S | | 2/2001 | Hardaway | |
| D437,719 | S | | 2/2001 | Dicellis | |

(Continued)

*Primary Examiner*—Anthony D. Stashick
*Assistant Examiner*—Harry A. Grosso
(74) *Attorney, Agent, or Firm*—Kenneth J. Lukacher; Martin Lukacher

(57) ABSTRACT

Container storage organizers are provided by an integral and preferably molded plastic shell having a profile defined by top panels and side panels of the shell, which side panels meet the top panels and extend to an open bottom. The profile provides a shape enabling one or more of the shells to be assembled in adjacent and preferably adjoining relationship. The top sides of the profile meet at an acute angle preferably about 90° while the sides are generally parallel, preferably having a slight taper so as to enable several shells to be stacked on top of another for ease of shipment and handling. One of the top panels has a plurality of side-by-side openings which receive the containers, such as cans, through lips which guide the cans into the shell so that they rest on a base to which the shell is attached, preferably by tabs which extend laterally from the lower edges of the side panels. The edges of the side panels are notched so that the tabs extend through the notches and into interdigited relationship to facilitate the mounting of the shells in adjoining each other on the base. The shells may be mounted vertically on a vertical wall, which provides the base, or horizontally on a horizontal floor or table.

22 Claims, 12 Drawing Sheets

U.S. PATENT DOCUMENTS 6,189,635 B1 * 2/2001 Schuler et al. ..... 180/68.5
6,349,820 B1 2/2002 Kelley et al.
6,425,489 B1 * 7/2002 Cunningham ..... 211/70.6
D468,162 S 1/2003 Martin
D468,591 S 1/2003 Lillelund et al.
6,502,711 B1 1/2003 Mc Rae
D469,926 S 2/2003 Petruccelli

* cited by examiner

CONTAINER STORAGE ORGANIZERS

The present invention relates to container storage organizers and particularly to organizers made of individual organizer units wherein containers may be inserted and held and which units are mountable adjacent to each other (side-by-side) in a stack or arrayed either vertically on a wall or horizontally on a floor or table; the profile of the organizer units enabling the side-by-side orientation of several organizer units and the holding of cans for other containers securely without rattling or falling out of the organizer units regardless of their vertical or horizontal orientation. By the term "containers" as used herein is meant cans either round or square or other cross-sectional shape and whether open at an end at end thereof or closed at both ends.

While organizer units for holding cans and alike have been proposed, such organizer units are designed to hold a fixed number of cans and are not readily expandable so as to provide for organized storage (which terms include holding for display) of the cans. It is the principal feature of the present invention to provide container storage organizers in individual organizer units, which provide for sturdy holding of a plurality of cans and enable several similar organizer units, which can hold the same number or more or less containers, to be arrayed adjacent to each other and mounted either vertically on a wall, or horizontally on a floor or table surface. The storage capacity of an organizer provided by the invention is expandable by virtue of the shape of the profile of the individual organizer units.

It is another feature of the invention to provide a profile formed by a top wall having a plurality of panels at about 90° to each other, one of these panels having openings for receiving containers and the other of which assures the spacing of adjacent organizer units so that they do not interfere with each other in the storage of the containers therein, via their respective openings, whether the organizer units are arrayed horizontally or vertically.

It is a still further feature of the invention to provide a profile with sufficient taper to enable multiple organizer units to be placed in nested relationship for handling or shipment.

It is still a further feature of the invention to provide the organizer units with extensions or tabs, which when the units are arrayed adjacent to each other, extend through notches so as to be disposed in interdigited relationship. Attachment hardware such as screws may be inserted via openings in these tabs so as to firmly attach the units, whether vertically to a wall, or horizontally to a floor or table.

Briefly described, container storage organizers provided by the invention use a shell having a profile of quadrilateral shape with a top pair of sides separately meeting generally parallel sides. The top sides meet each other at an acute angle, preferably approximately 90°. The shell is open at the bottom. The generally parallel sides and the top sides are defined by panels. A larger one of the top panels had openings, and because of the angle of these openings and the orientation of the other top panel, directs containers into the shell so that they rest at the end thereof on a base to which the shell is attached and provides secure holding of the containers whether the base is horizontal or vertical. A plurality of shells of like profile may be disposed adjacent (side-by-side) to each other with their side panels in contact or closely spaced from each other, thereby providing an expandable array of shells with expandable container storage capacity.

The foregoing and other objects, features and advantages of the invention will become more apparent from a reading of the following description in connection with the accompanying drawings in which:

FIG. 9 is a fragmentary sectional view of the adjoining container storage organizer units, the view taken along line 9—9 in the direction of the arrows as shown in FIG. 8;

Figure 1:
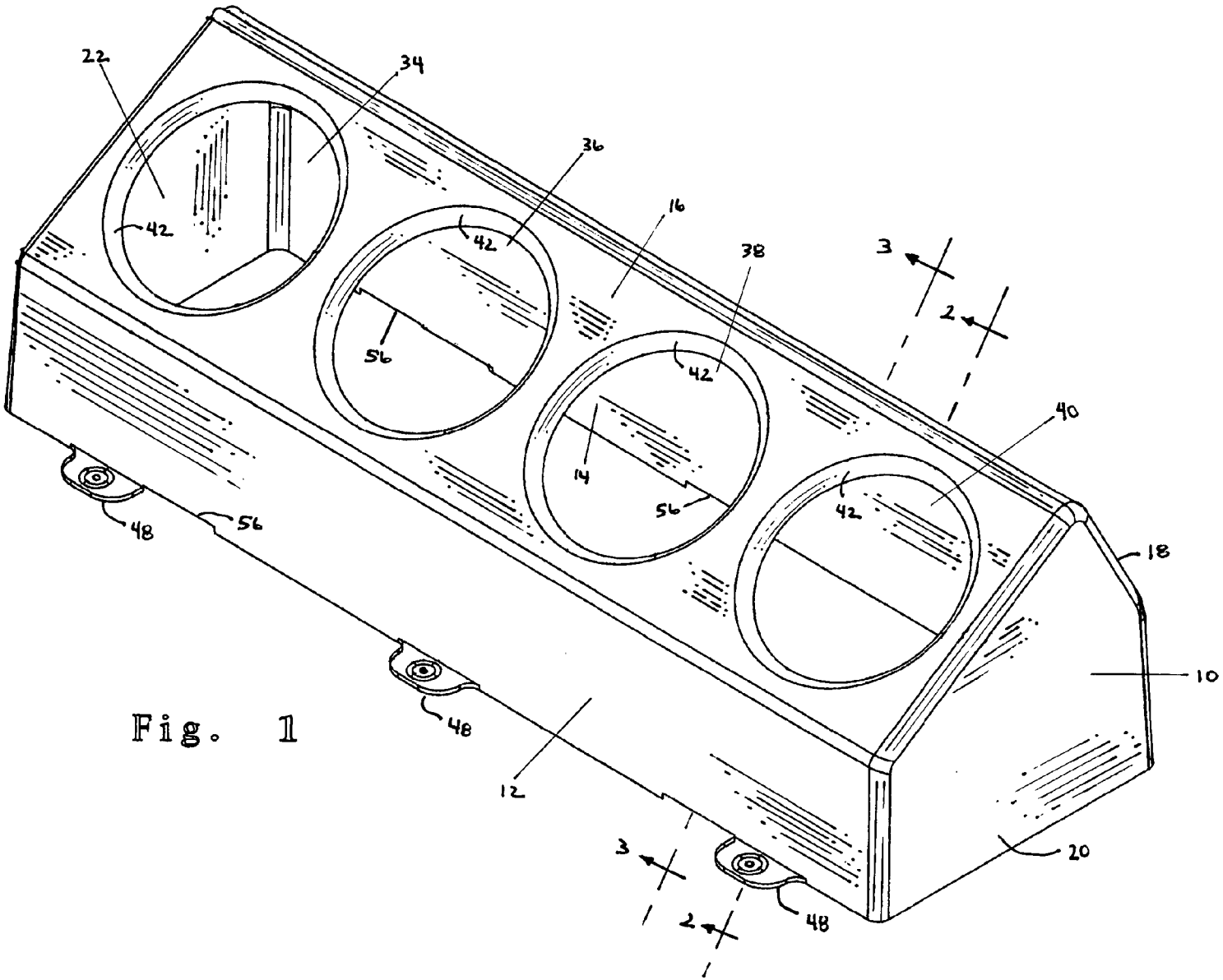
FIG. 1 is a perspective view of a container storage organizer unit.
Figure 2:
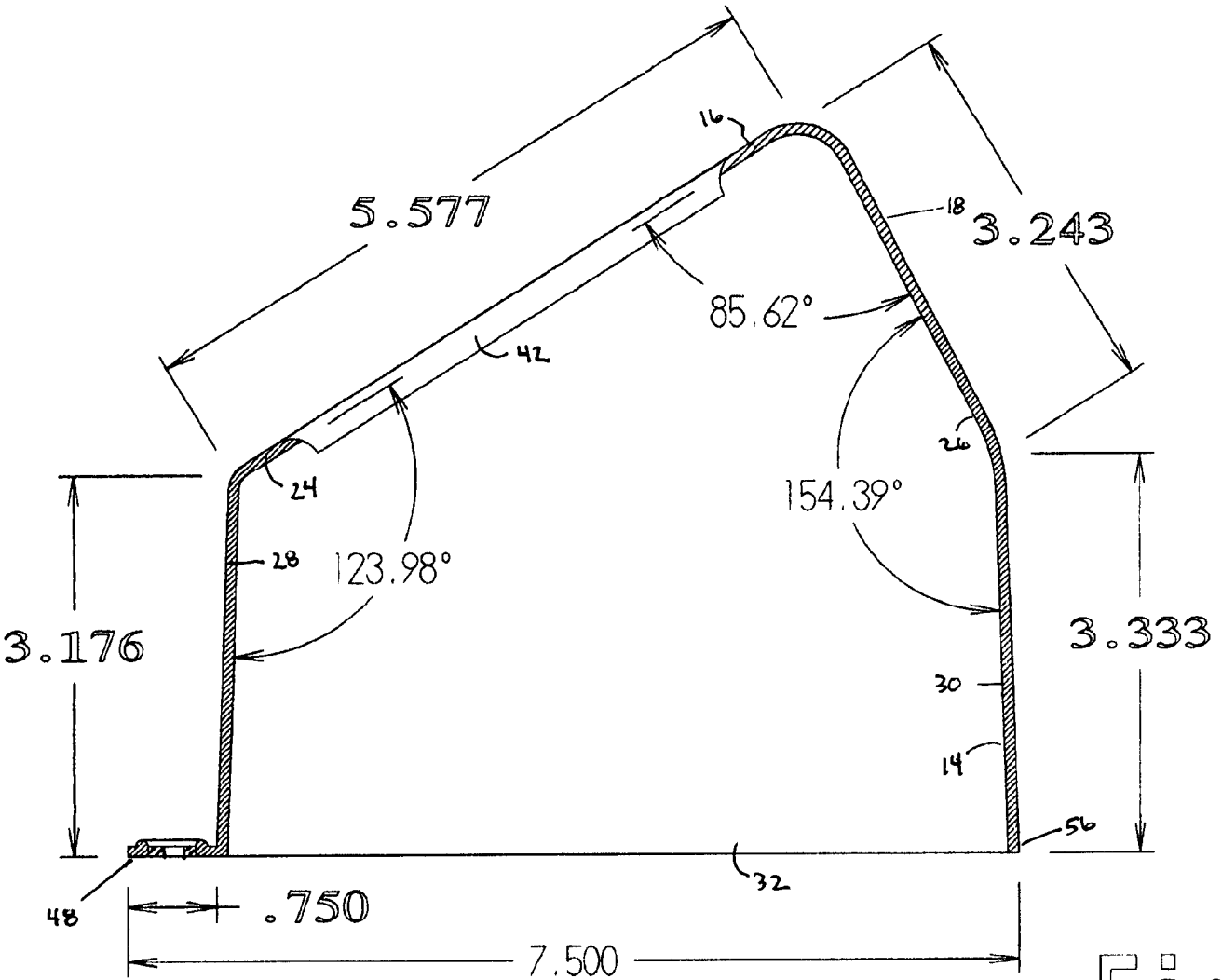
FIG. 2 is a sectional view along the line 2—2 in FIG. 1.
Figure 3:
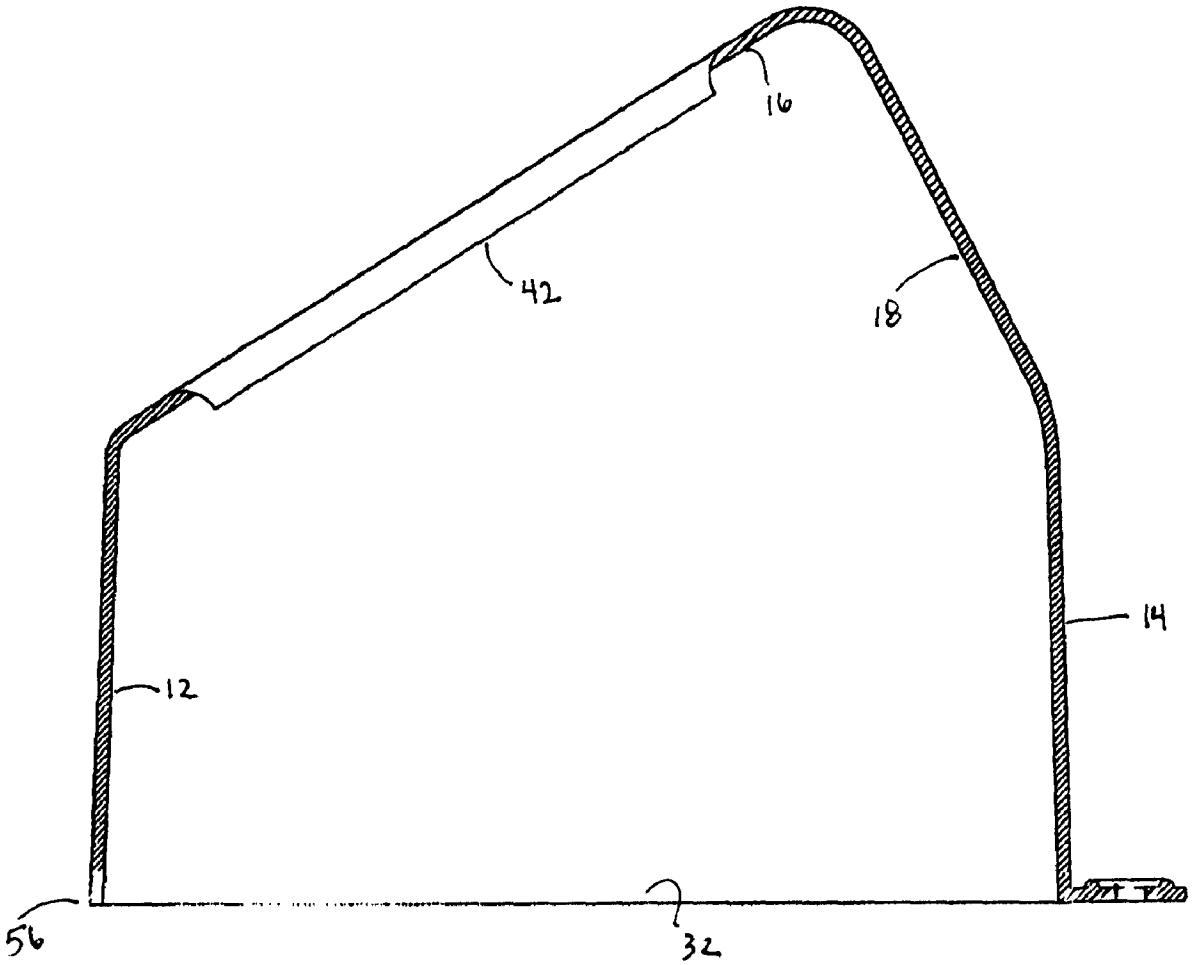
FIG. 3 is a sectional view along the line 3—3 in FIG. 1.

Referring to the drawings and particularly to FIGS. 1, 2 and 3, there is shown a container storage organizer unit adapted to hold and store or display four cans. The organizer unit is provided by a shell 10 of sheet material and is preferably an integral moldment of plastic. The shell has a profile of quadrilateral shape defined by side panels 12 and 14 and top panels 16 and 18. The shell preferably has end panels 20 and 22. These end panels are not essential, especially where the other panels are thick enough to be self-supporting in the shape of the profile of the organizer unit. As shown in FIGS. 2 and 3, the top sides 24 and 26 of the profile defined by the top panels meets at an acute angle preferably about 90° (85.62°, as shown by way of example). The sides 28 and 30 of the profile are generally parallel but may be at a tilted inwardly at a small angle sufficient to allow the shells to be placed in nested relationship for shipment or handling. The sides 28 and 30 are approximately of the same height above the lower edges of the side panels 12 and 14 which define the open bottom 32 of the shell.

The larger of the top panels 16 has four openings of a diameter or shape corresponding the shape of the containers, here illustrated as round cans. The openings would be of other shapes (square or rectangular or oblong etc.) depending on the cross-section of other styles of containers. These openings 34, 36, 38 and 40 preferably have lips 42 which guide the cans into the shell.

The side panels 12 and 14 and the sides 28 and 30 of the profile meet the top panel 16 and 18 and top sides 24 and 26 of the profile at obtuse angles. For example, top sides 24 and 26 meet sides 28 and 30 at 123.98° and 154.39°, respectively, as shown in FIG. 2, but other obtuse angles may be used. Because of these angles, the can is spaced from the overhanging cover of the bottom or smaller top panel 18 and has its ends resting on a base (e.g., the wall 50 in FIGS. 10 and 11, or the floor or tabletop 52 shown in FIGS. 12 and 13). By virtue of the shape of the profile, shells of similar profile may be mounted on a base in side-by-side relationship as shown in FIGS. 5, 6, 10, 11, 12 and 13. The profile permits the side panels to be essentially in adjoining or touching relationship. They may be slightly spaced to accommodate the taper which facilitates nesting or handling and storage as mentioned above.

Figure 5:
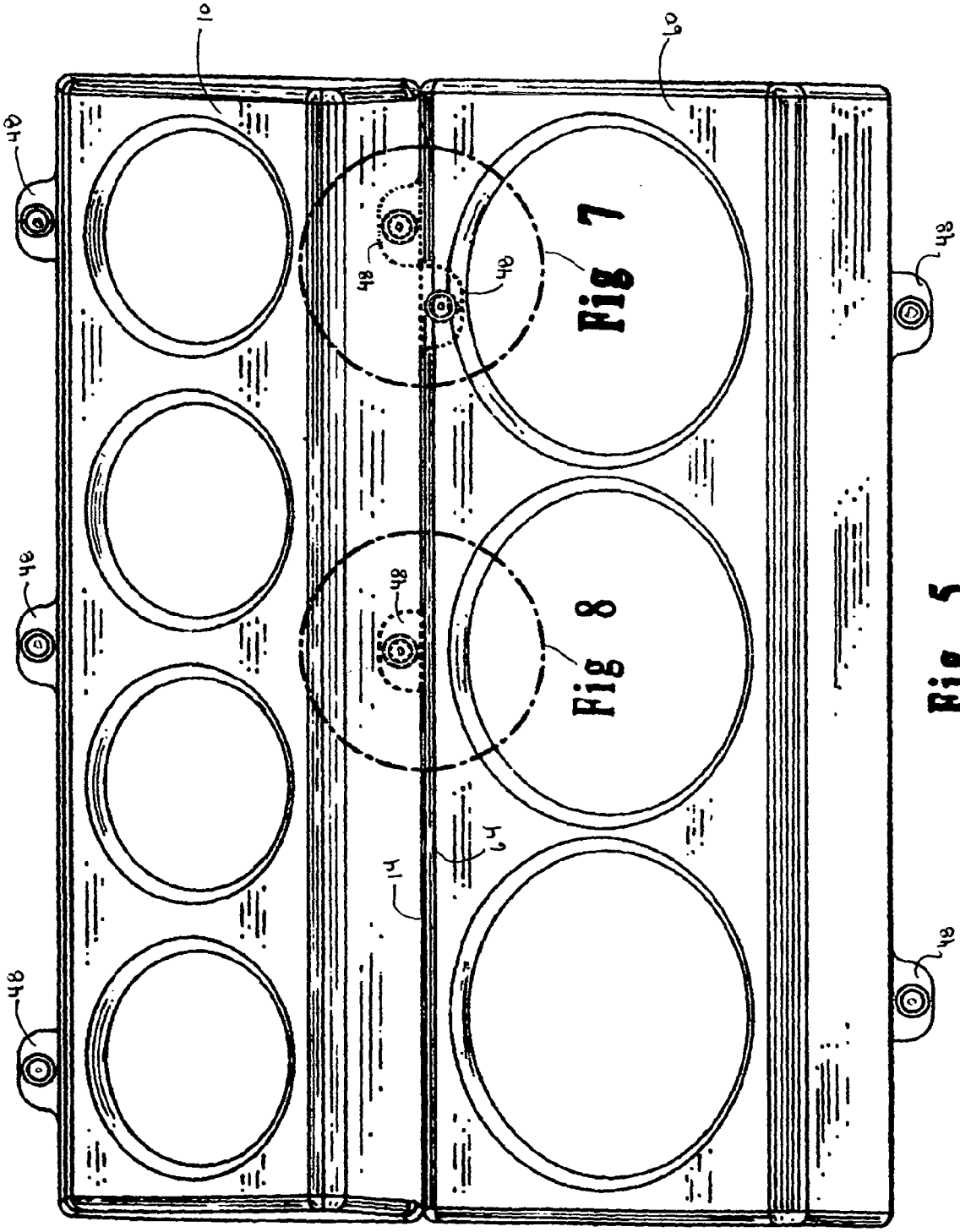
FIG. 5 is a plan view showing a pair of containers, one as shown in FIG. 1 and the other as shown in FIG. 4 dispose in side-by-side relationship.
Figure 6:
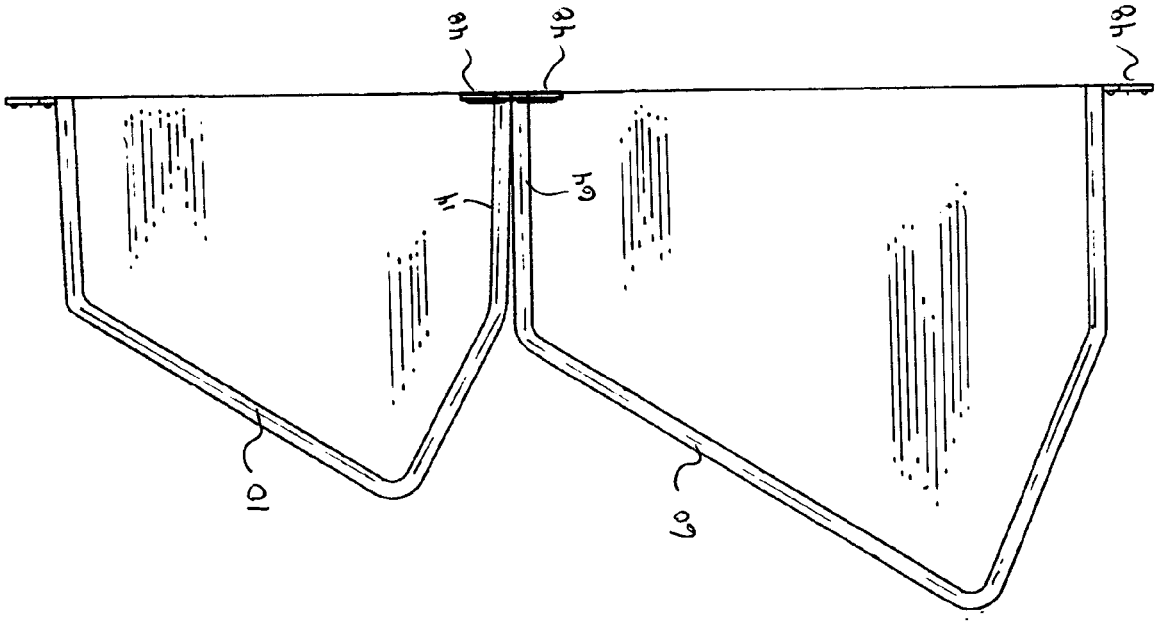
FIG. 6 is an end view of the adjoining container storage organizer units shown in FIG. 5.

In order to mount the shells on the base, a plurality of tabs 48 project laterally from the lower edge of the side panels. There are three tabs from the left side panel 12 and two from the right side panel 14 which tabs are offset from each other. The bottom side edges are aligned with tabs of adjoining organizer units in notches 56. When the shells are disposed side-by-side, for example as shown in FIGS. 5 and 6, the tabs 48 extend through the notches 56 so that the tabs are interdigited. This interdigited relationship is also clearly shown in FIG. 7.

The attachment to the base may be through holes surrounded by ridges in tabs 48, which protect screws extending through the holes into the base. Access to the screws is either from the outside of the shell or through the openings 34–40.

One feature provided by the angles where the two top sides 24 and 26 meet respective sides 28 and 30, as described above, is that when multiple container organizer units are stacked in either a horizontal or vertical orientation along a base surface the containers are received in the opening 34–40 along a downwardly projecting angle which enables contents to be retained within the containers while enabling full unobstructed access to the containers. The containers in each stacked unit in their respective openings may be in a single row. Although openings 34–40 are to a cavity formed by the interior of the shell of the organizer unit and a base surface, optionally one or more of the openings 34–40 may be to an open or closed ended chamber extending on a downward angle from top wall 24 having a cross-section shape in accordance with the containers to be received therein. Such chamber may be molded with the shell providing the unit. In the case of a can, such as a used coffee can, the cross-sectional shape of the openings 34–40 (and chamber, if present) would be circular and have a slightly larger diameter than the outer diameter of the can such that each can slides into its respective opening and extends partially there from.

Figure 4:
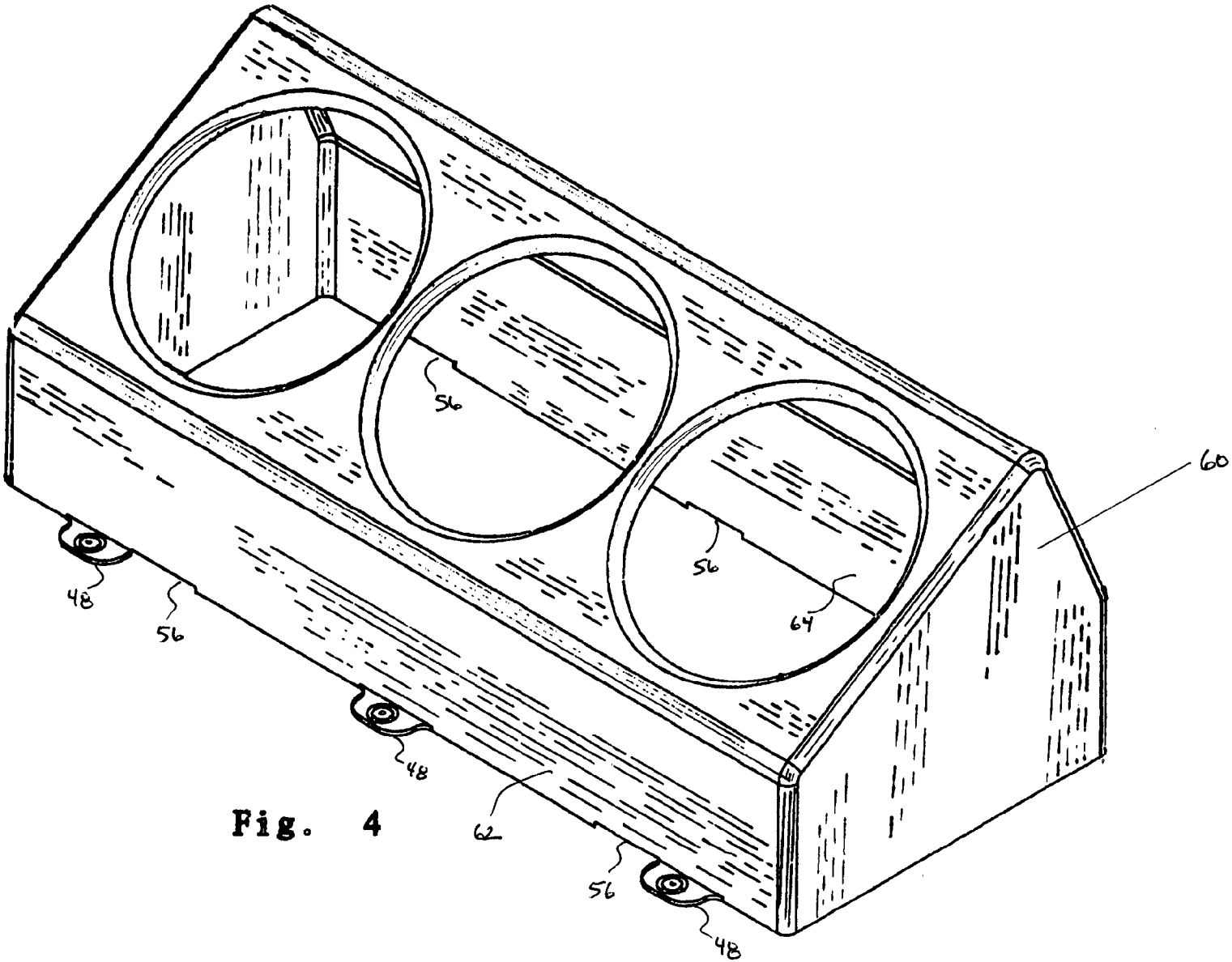
FIG. 4 is a perspective view of a container storage organizer unit which is adapted to store three containers of larger diameter than the four containers which may be received in the organizer unit shown in FIGS. 1 to 3.
Figure 11:
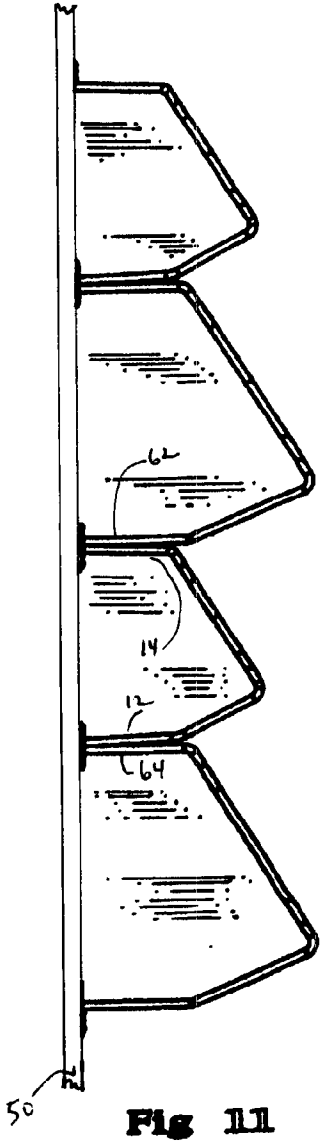
FIG. 11 is an end view of the array of container storage organizer units shown in FIG. 10.
Figure 10:
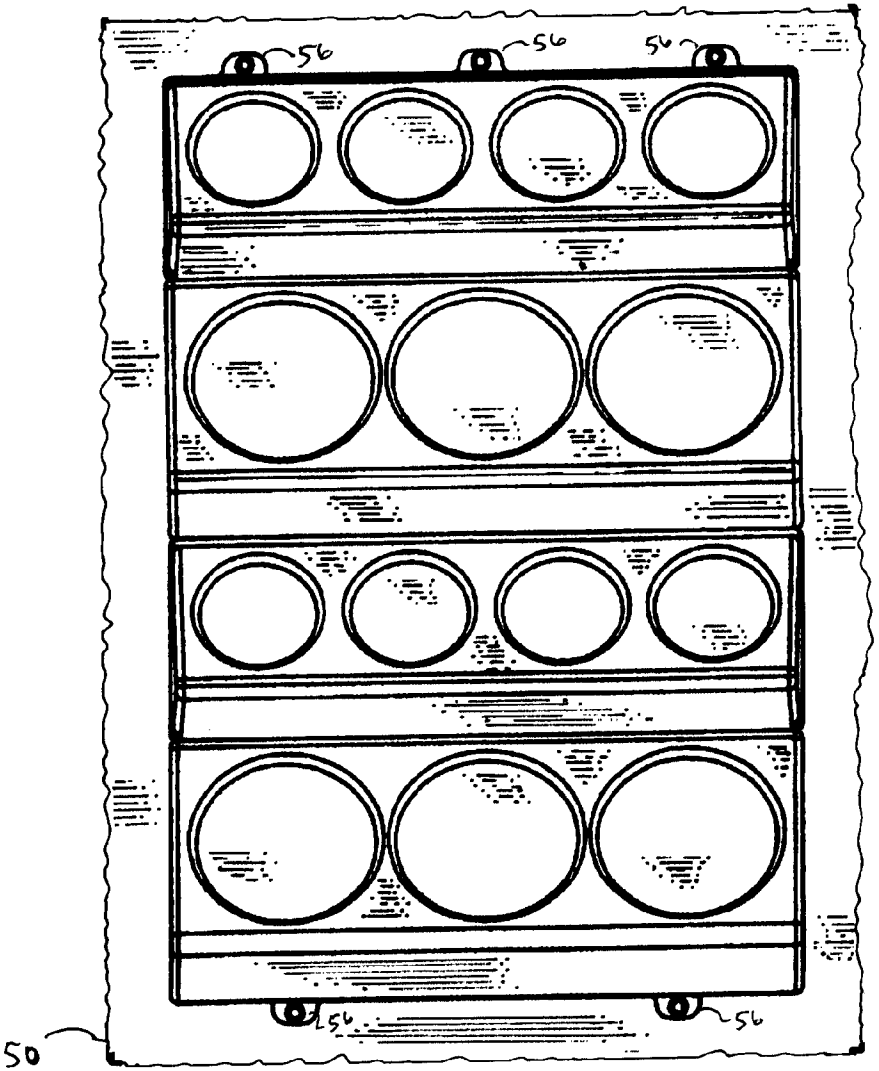
FIG. 10 is a plan view of a vertical array of four container storage organizer units, two as shown in FIG. 1 and two as shown in FIG. 4, mounted on a wall so as to be in vertical orientation.

Referring next to FIG. 4 there is shown a container storage organizer unit for three containers, namely cylindrical cans which are larger than the four cans which are stored in the unit shown in FIG. 1. The three-can organizer unit has the same profile as the four can organizer unit. The dimensions shown by way of example in FIG. 2 for the four-can organizer unit are larger in the same proportion as the dimensions (diameter) of the cans which are received in the four-can organizer unit are to the cans which are received in the three-can organizer unit. The three-can organizer unit is preferably molded into a shell 60 having the herein described profile. The shell is open at the bottom and has generally parallel side panels 62 and 64 which facilitate compact arrangements of the organizer units with the side panels adjacent to each other as shown in FIGS. 5, 6, 10, 11, 12 and 13. Preferably, the organizer units are of the same length as measured along the long dimension of the side panels 12, 14, 62 and 64 so as to facilitate arrays with groups of organizer units in end-to-end relationship. For example, a group of four organizer units as shown in FIG. 10 and 11 may have another group of four organizer units adjoining end-to-end so as to provide an eight organizer unit array. There is no limitation upon the number of organizer units which can be arrayed end-to-end or stacked vertically, except for the height, width, length and area of the base surface (e.g., the wall or table) on which the organizer units are mounted. Tabs 48 may be used to facilitate the mounting to the base, and the bottom of the side walls 62 and 64 may have notches 56 as was described in connection with FIGS. 1–3 so as to enable interdigited locations for the tabs and to facilitate the compact nature of the arrays.

FIGS. 5 and 6 show a pair of shells 10 and 60 respectively for a four-can and three-can organizer units with their side panels 14 and 64 in adjoining relationship.

Figure 7:
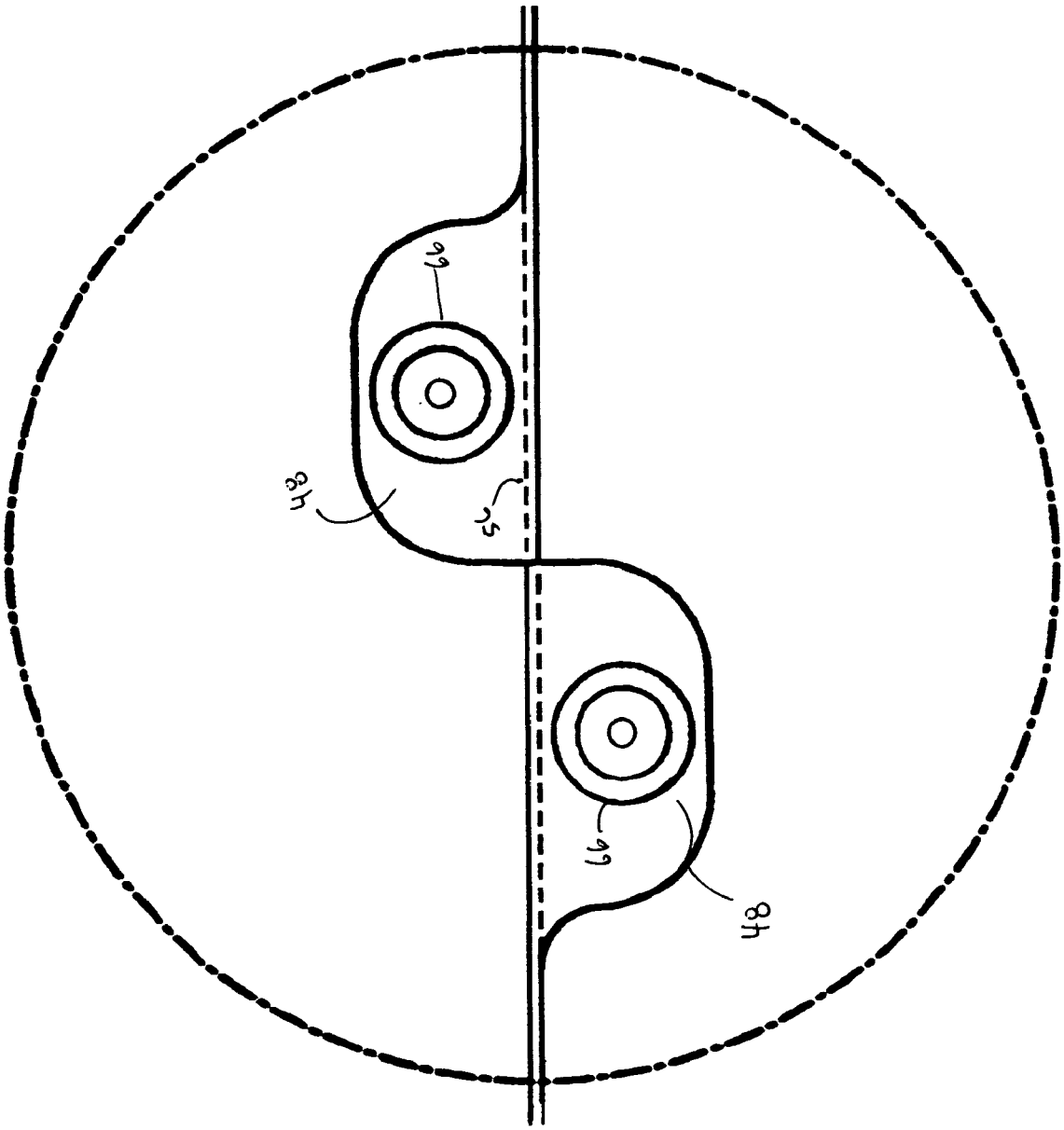
FIG. 7 is a fragmentary sectional view taken along the circular line of short and long dashes shown in FIG. 5 and indicated FIG. 7.
Figure 8:
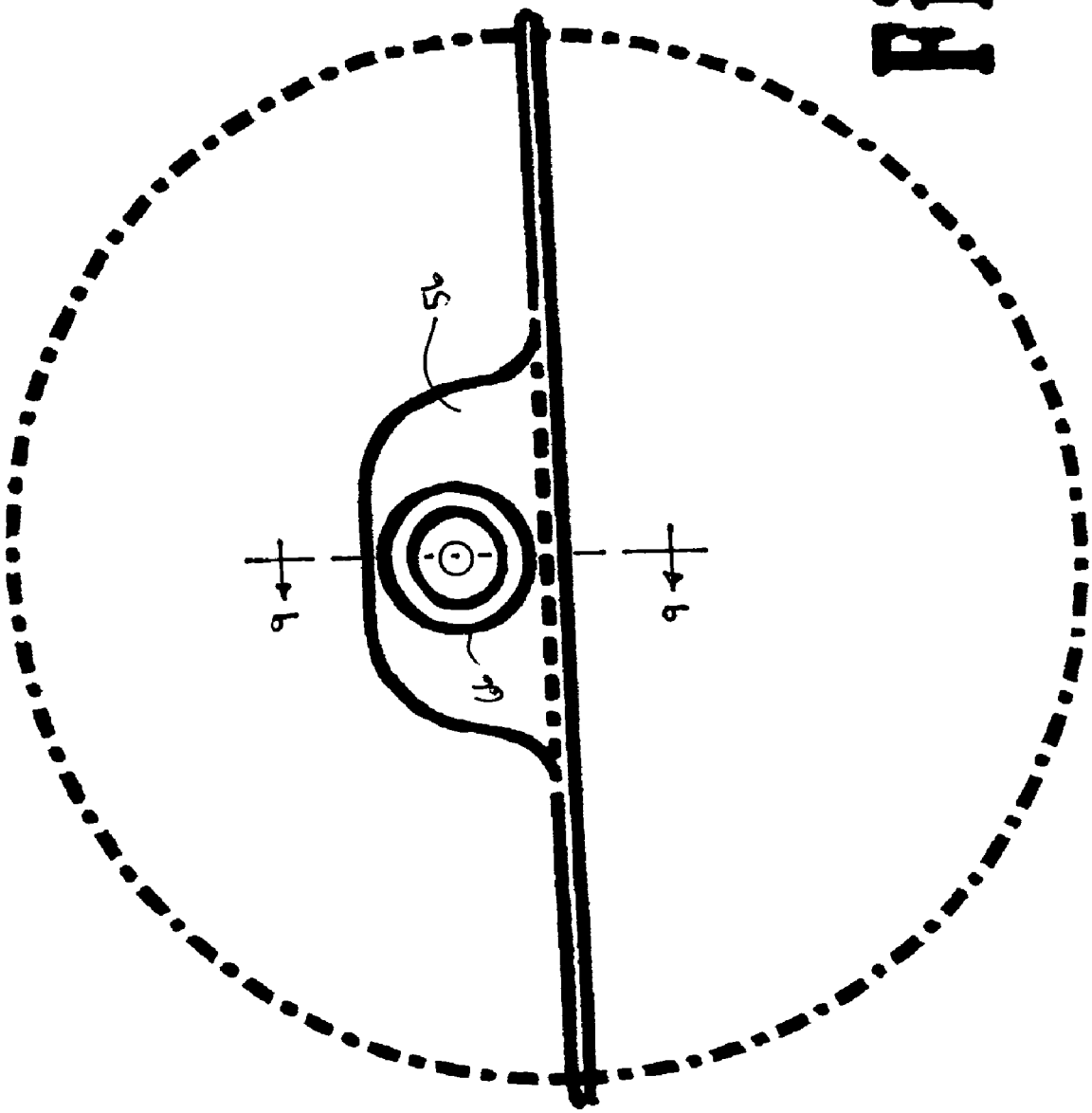
FIG. 8 is a similar fragmentary sectional view internally of the container shown in FIG. 5 within the circle shown by the line of short and long dashes indicated FIG. 8.
Figure 8:
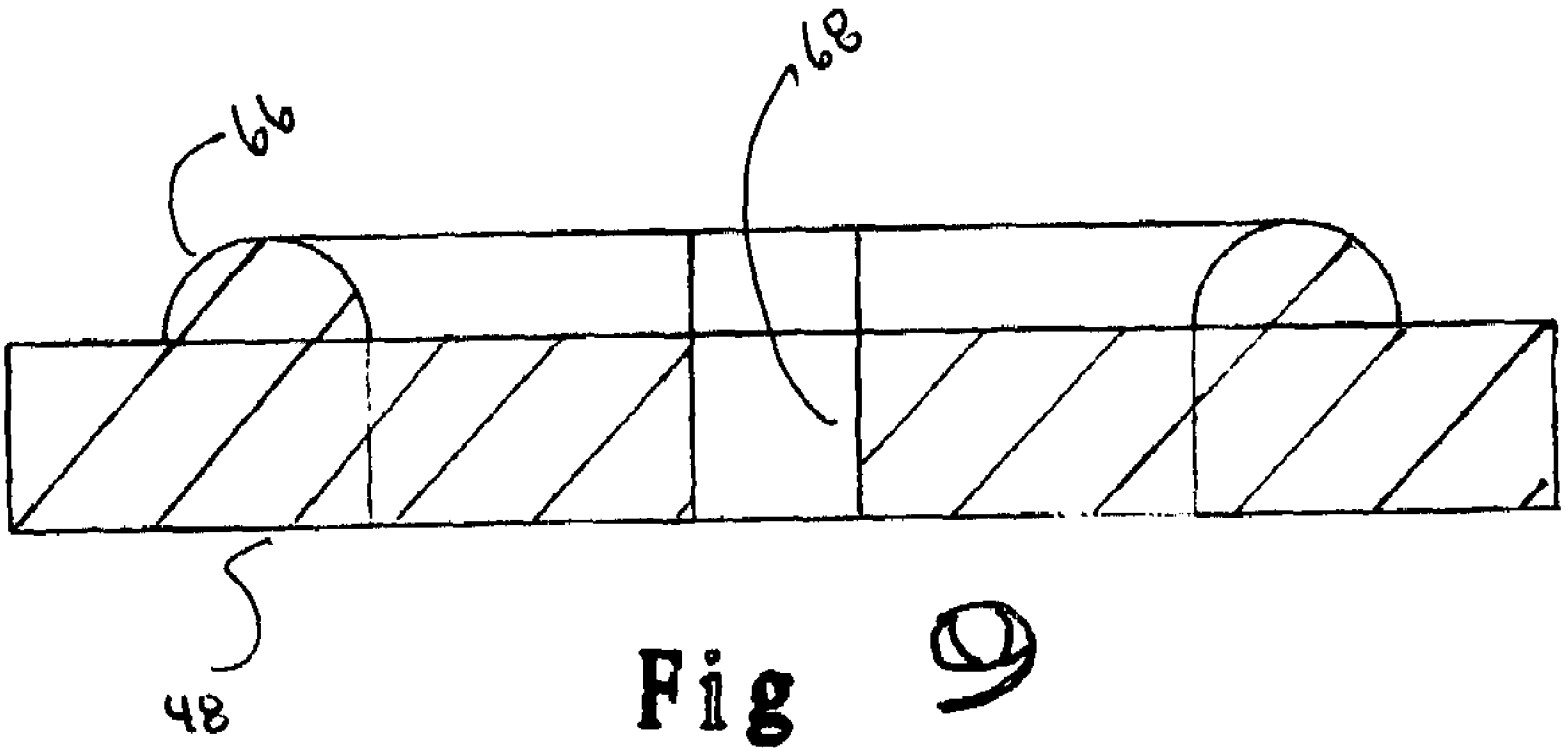

The interdigited relationship of the tabs 48 and their passageways through the slot 56 are more apparent in FIGS. 7 and 8. FIG. 9 shows a tab 48 in the vicinity of a circular ridge 66 which surrounds a mounting hole 68 through which a screw or other attachment hardware may be extended into the base upon attachment of the organizer units individually or in arrays.

FIG. 10 an alternative array of like profile organizer units for three and four cans mounted on a base 50. The closely adjacent side panel to side panel disposition of the organizer units is also shown in FIGS. 10 and 11.

Figure 12:
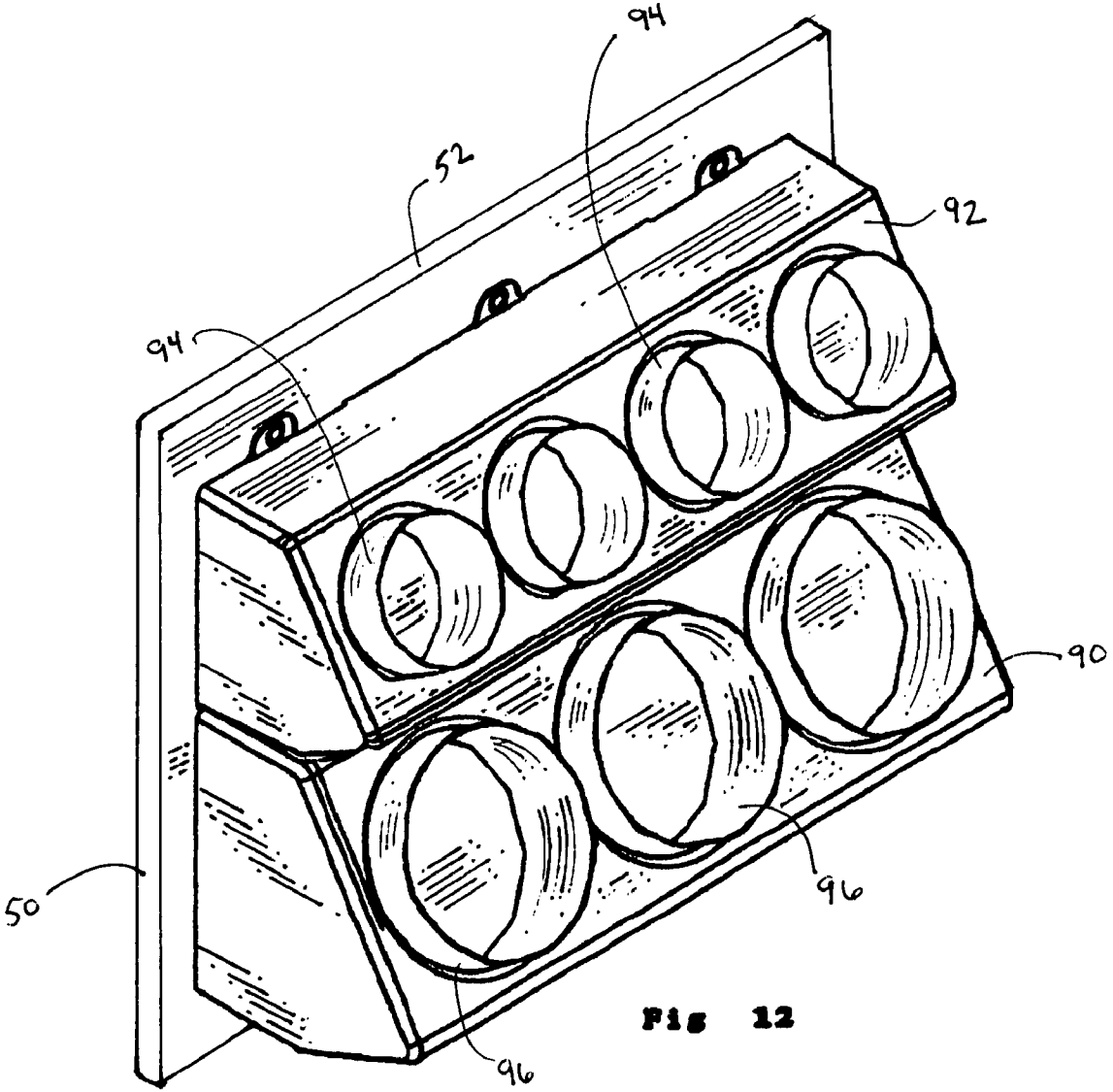
FIG. 12 is a perspective view of a pair of adjoining container storage organizer units such as shown in FIG. 5 mounted vertically on a wall and having in the openings in the top panels thereof a plurality of cans closed at their lower ends and open at their top ends so as to facilitate storage of objects in the cans.
Figure 13:
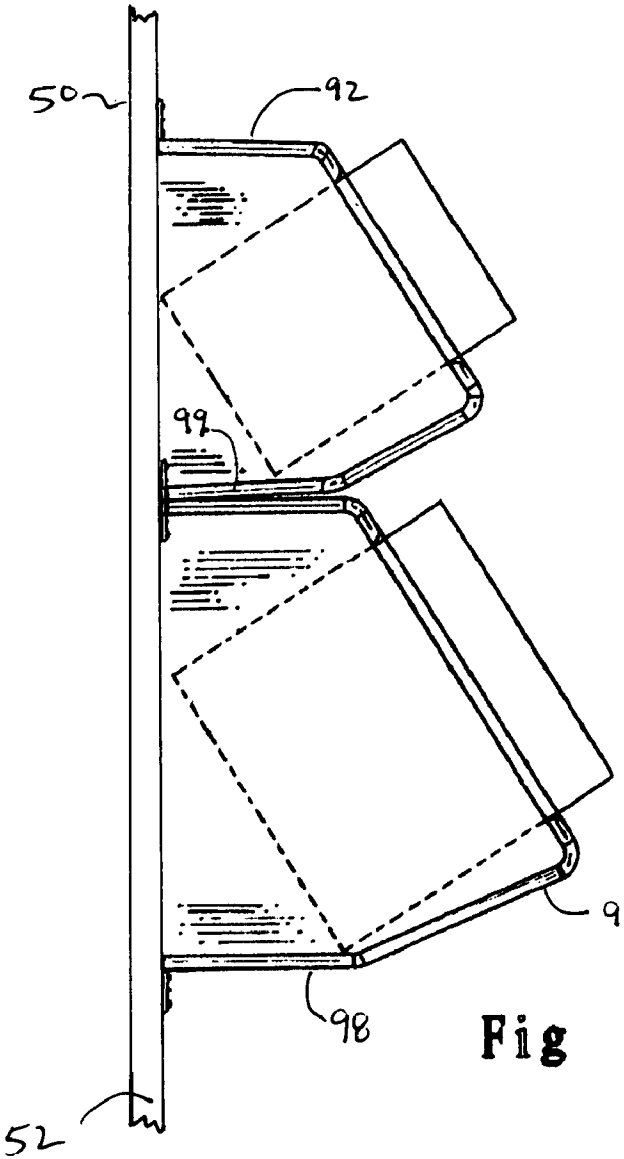
FIG. 13 is an end view of the array of container storage organizer units shown in FIG. 12.

FIGS. 12 and 13 illustrate a pair of three-can and four-can organizer units 90 and 92, similar to the organizer units shown in FIGS. 5 and 6, mounted on a vertical base, such as a wall 50. Cans of relatively smaller and larger diameter which are open at their top ends and closed as their bottom ends are installed in the openings in the organizer units 90 and 92. These cans are illustrated at 94 and 96 for the smaller and larger cans, respectively. The cans are closed at their lower ends and the lower ends, because of the profile of the organizer units 92 and 94 are securely positioned by contact with the lower side panel 98 and 99 and the base 50. While the cans 94 and 96 are shown open at their top ends, to facilitate their use as holders for objects such as brushes and other tools or materials for convenient storage therein, the cans 94 and 96 may be closed at both ends. The organizer unit therefore serves both for storage and display purposes.

From the foregoing description it will be apparent that there has been provided improved container storage units having distinctive profiles which facilitate compact arrangements of the organizer units in arrays of either one of two orthogonal orientations as well as to provide firm seating and secure holding of the cans and other containers in the container units. Dimensions and angles have been given to facilitate the understanding of the invention and not by way of limitation. The illustrated description as a whole is to be taken as illustrative and not as limiting of the scope of the invention. Such variations, modifications and extensions, which are within the scope of the invention, will undoubtedly become apparent to those skilled in the art.

What is claimed is:

1. Container storage organizer apparatus comprising a shell having a profile of quadrilateral shape with top panels defining a pair of, top sides separately meeting generally parallel sides, said top sides meeting each other as an acute angle, said shell being open at a bottom thereof, which faces said top sides, side panels of said shell defining said parallel sides, only one of said pair of top sides having container receiving openings, the other of said pair of top sides being narrower in width than said one top side thereby enabling each of said side panels to be positioned adjacent to side panels of another shell of like profile when said shells are mounted on a base disposed horizontally or vertically with said side panels extending to said base and said base closing said bottom, said shell being internally unobstructed between said top sides and along the entire length of said side panels to said base, so that containers can be located in said openings with ends thereof resting against said base when said shell is mounted on said base.

2. The container storage organizer according to claim 1 wherein said one of said pair of top sides of said profile which defines said panel having said openings is larger in area than said other of said pair of said top sides thereof.

3. The container storage organizer according to claim 2 wherein said generally parallel sides of each are of approximately equal length.

4. The container storage organizer according to claim 1 wherein said acute angle is approximately 90°.

5. The container storage organizer according to claim 4 wherein said parallel sides are approximately of equal length.

6. The container storage organizer according to claim 4 wherein said top sides of said profile define obtuse angles with said parallel sides where such said parallel and top sides meet.

7. The container storage organizer according to claim 1 wherein said opening has lips tapering inwardly of said shell.

8. The container storage organizer according to claim 1 wherein said side panels have tabs extending outwardly thereof from edges of said side panels which meet said base through which attachment elements can extend for attaching said shell to said base.

9. The container storage organizer according to claim 8 wherein said tabs have generally circular ridges on surfaces thereof facing away from said base, said ridges protecting holes in said tabs, via which said elements attaching said shells to and base, extend.

10. The container storage organizers according to claim 1 wherein said shell is an integral member.

11. The container storage organizers according to claim 10 wherein said integral shell member is molded of plastic material.

12. Container storage organizer apparatus comprising a shell having a profile of quadrilateral shape with top panels defining a pair of top sides separately meeting generally parallel sides, said top sides meeting each other as an acute angle, said shell being open at a bottom thereof, which faces said top sides, side panels of said shell defining said parallel sides, each of said side panels being adapted to be positioned adjacent to side panels of another shell of like profile when said shells are mounted on a base disposed horizontally or vertically with said side panels extending to said base and said base closing said bottom, a pair of top panels defining said top sides of said profile, one of said top panels having container receiving openings therein so that containers can be located in said openings with ends thereof resting against said base when said shell is mounted on said base, said side panels have tabs extending outwardly thereof from edges of said side panels which meet said base through which attachment elements can extend for attaching said shell to said base, and wherein said tops have generally circular ridges on surfaces thereof facing away from said base, said ridges extending away from said facing away surfaces holes, said ridges protecting holes in said tabs via which said elements attaching said shells to and base extend wherein said side walls have notches alignable with the tabs extending from side walls of adjacent shells and through which said tabs extend.

13. The container storage organizer apparatus according to claim 12 wherein said notches are of sufficient height to clear said tabs and ridges on said tabs around holes therein.

14. A container organizer comprising:

two top walls meeting at an angle of approximately 90 degrees or less;

two generally parallel side walls each meeting a different one of said top walls at an obtuse angle defining a single compartment in which said containers are received; and only one of said one of said top walls and not the other has a plurality of openings for receiving containers, said other top wall being narrower than said one top wall.

15. The container organizer according to claim 14 further comprising two opposing end walls each meeting a different end of said top and side walls.

16. The container organizer according to claim 14 wherein said openings are in a single row along said one of said top walls.

17. The container organizer according to claim 14 wherein said container organizer represents one of a plurality of said container organizers in which said plurality of container organizers are stackable along a surface such that two adjacent ones of said plurality of container organizers have said side walls adjacent to each other.

18. The container organizer according to claim 17 wherein said plurality of container organizers are stackable in two different orientations along the surface in which containers are receivable in said opening along a downwardly projecting angle which enables contents to be retained within said containers while enabling unobstructed access to the containers.

19. The container organizer according to claim 14 wherein each of said openings have a cross-section in accordance with a cross-section of the containers to be received in the opening.

20. A container organizer comprising:

two top walls meeting at an angle of approximately 90 degrees or less;

two generally parallel side walls each meeting a different one of said top walls at an obtuse angle defining a single compartment for which said containers are received; and only one of said one of said top walls and not the other has a plurality of openings for receiving containers; and a bottom opening facing said two top walls, and means for mounting said container organizer upon a surface along said bottom opening.

21. The container organizer according to claim 14 wherein the containers receivable in said openings represent cans.

22. The container organizer according to claim 14 wherein one or more of said openings opens into a chamber extending from said top wall which has said openings, and said chamber has one of open or closed ends and a cross-sectional shape capable of receiving a container.

* * * * *